United States Patent [19]

Weirich et al.

[11] Patent Number: 4,572,709

[45] Date of Patent: Feb. 25, 1986

[54] CONTROL APPARATUS

[75] Inventors: Walter Weirich, Dortmund; Michael Dettmers, Kamen, both of Fed. Rep. of Germany

[73] Assignee: Gewerkschaft Eisenhütte Westfalia, Lünen, Fed. Rep. of Germany

[21] Appl. No.: 481,964

[22] Filed: Apr. 4, 1983

[30] Foreign Application Priority Data

Apr. 6, 1982 [DE] Fed. Rep. of Germany ..... 3212747

[51] Int. Cl.[4] ..... E21D 15/44

[52] U.S. Cl. ..... 405/302; 91/170 MP; 137/529

[58] Field of Search ..... 405/291–302; 91/170 MP; 137/529; 299/33

[56] References Cited

U.S. PATENT DOCUMENTS

| | | | |
|---|---|---|---|
| 3,672,174 | 6/1972 | Von Hippel | 405/295 |
| 4,220,424 | 9/1980 | Nerlich | 405/302 |
| 4,236,850 | 12/1980 | Koppers et al. | 405/291 |
| 4,279,271 | 7/1981 | Neff | 137/529 |

FOREIGN PATENT DOCUMENTS

| | | | |
|---|---|---|---|
| 2749312 | 5/1979 | Fed. Rep. of Germany | 405/302 |

*Primary Examiner*—David H. Corbin
*Attorney, Agent, or Firm*—Neil F. Markva

[57] ABSTRACT

Apparatus for controlling the working stoke of the hydraulic props of a mine roof support unit is disclosed. The control apparatus comprises a control valve whose input side is connected to a hydraulic pressure line, and whose output side is connected to a working chamber of each of the props via a respective supply line. A sequence valve is provided in the supply line leading to one of the props. The sequence valve is such as to open the associated supply line when subjected to a predetermined hydraulic pressure, this predetermined hydraulic pressure being at least approximately equal to the hydraulic pressure necessary to overcome the resistance to the working stroke of another of the props. The sequence valve has a tubular valve body, a valve closure element mounted within the valve body, and a valve seat positioned within the valve body. A spring is provided for biassing the valve closure element towards the valve seat. A control piston carries the valve seat, the control piston having a piston face which, when subjected to hydraulic pressure in the biassing direction of the spring, is effective to displace the control piston so as to move the valve seat away from the valve closure element, thereby opening the sequence valve.

31 Claims, 5 Drawing Figures

CONTROL APPARATUS

BACKGROUND TO THE INVENTION

This invention relates to apparatus for controlling the working stroke of each hydraulic ram of a group of hydraulic rams, and to a sequence valve for use in such control apparatus. The invention is particularly concerned with apparatus for controlling the working strokes of the hydraulic props of a mine roof support unit.

Hydraulic roof support systems of the type used in longwall workings in underground mining operations usually comprise a plurality of self-advancing roof support units, each roof support unit typically has at least two, and in many cases four or more, hydraulic props which are connected to a hydraulic pressure line (which extends along the longwall working) by way of a common control valve. This control valve is usually a manually-operated and/or remote-controlled valve. When the valve is actuated, all the props of the associated roof support unit are simultaneously pressurized. In this case, the prop(s) that has (or have) the least resistance to extension move out before the prop(s) that has (or have) the greater resistance to extension. In the case of a roof support unit that has two props (or two pairs of props) arranged one behind the other in the direction of advance of the unit, and where the unit incorporates a roof cap which projects over a considerable distance towards the work face, the resistance to extension of the forward prop(s) is (or are) considerably greater than that of the rear prop(s). This is because of the different distribution of the weight of the roof cap on the props. Consequently, during the setting process, preferential outward thrust is applied to the rear prop(s). Indeed, in some circumstances, the front prop(s) is (or are) extended only when the rear prop(s) has (or have) already moved into contact with the roof. If, as is often the case in operations involving roof breakdown, the roof contains a cavity in the zone of the rear prop(s), the cap is forced into the cavity by the rear prop(s). In some circumstances, it is then not possible to contact the forward region of the sharply-inclined roof cap with the roof, and to clamp it against the roof by means of the front prop(s).

Where the props of a roof support unit have short extension lengths, and the unit has a goaf shield loaded with the weight of rubble, the resistance to extraction of the rear prop(s) may be, in some circumstances, greater than that of the front prop(s). In this case, the front prop(s) is (or are) preferentially extended during setting of the roof support unit. In this event, a roof cavity in the vicinity of the work face can result in difficulties similar to those occurring in the first-mentioned case.

As is well known, the hydraulic roof support units include, in addition to their props, a relatively large number of hydraulic rams, such as, for example, advance rams, cap-positioning rams, alignment rams, and rams for moving gap-sealing shields. All of these rams must be actuated in synchronism with the props, or in a timed sequence relative to the movement of the props.

The aim of the invention is to provide control apparatus which does not suffer from the disadvantages associated with known types of control apparatus. In particular, the invention aims to provide apparatus for controlling the working strokes of a group of hydraulic rams in such a manner that, despite the individual rams having different resistances to extension and different loads, their working strokes can be regulated to achieve synchronism or, if required, a timed sequence. Another aim of the invention is to provide an operationally-reliable sequence valve for such control apparatus, which valve offers the possibility of applying, as far as possible, the full pump pressure to the hydraulic rams of a group.

SUMMARY OF THE INVENTION

The present invention provides apparatus for controlling the working stroke of each hydraulic ram of a group of hydraulic rams, the apparatus comprising a control valve whose input side is connectible to a hydraulic pressure line, and whose output side is connectible to a working chamber of each of the hydraulic rams via a respective supply line, wherein a sequence valve is provided in one of the supply lines, the sequence valve being such as to open the associated supply line only when subjected to a predetermined hydraulic pressure, said predetermined hydraulic pressure being at least approximately equal to the hydraulic pressure necessary to overcome the resistance to the working stroke of another hydraulic ram of the group.

The sequence valve, which is positioned in said supply line, results in the associated ram (or rams) being hydraulically pressurised only when said predetermined pressure has been reached. Thus, it is possible to equalize the differing resistances to the working strokes of the rams (which may occur because of differing loads or resistances to extension of the rams), and to achieve synchronism or, if required, a certain sequence of ram movements in the sense of follow-up control, so that the rams execute their working strokes in a predetermined sequence, irrespective of any differing resistances to their working strokes. In order to suit the opening pressure of the sequence valve to different operating conditions, the sequence valve may be adjustable so as to vary said predetermined hydraulic pressure.

Advantageously, the resistance to the working stroke of the hydraulic ram associated with the sequence valve is less than that of the other hydraulic ram(s) of the group, and wherein said predetermined hydraulic pressure is at least equal to the hydraulic pressure which is required to execute the working stroke of the hydraulic ram of the group that has the greatest resistance to its working stroke.

In a preferred embodiment, the sequence valve comprises a valve body, a valve closure element mounted within the valve body, a valve seat positioned within the valve body, and a spring for biassing the valve closure element towards the valve seat, wherein a control piston defines the valve seat, the control piston having a piston face which, when subjected to hydraulic pressure in the biassing direction of the spring, is effective to displace the control piston so as to move the valve seat away from the valve closure element, thereby opening the sequence valve.

Preferably, the valve clossure element has a generally frustoconical head and an axially-extending valve stem, the head being engageable with the valve seat. Advantageously, the biassing force of the spring can be varied by an adjustable setting member which acts as an abutment for the spring. The setting member may also constitute a hydraulic connector.

Conveniently, the sequence valve is provided with a retaining device which holds the sequence valve in the open position when the hydraulic pressure in the working chamber of the associated hydraulic ram is higher than said predetermined hydraulic pressure. This enables the full pressure of the pressure line to be applied to the ram connected to the outlet of the sequence valve, instead of this full pressure minus the opening pressure. Preferably, the control piston constitutes the retaining device, the piston face of the control piston being acted upon by the hydraulic pressure in the working chamber of the associated hydraulic ram. In such a system, the arrangement is expediently such that the closure element of the sequence valve can be lifted from its valve seat against the restoring force of the adjustable biassing spring, and such that the control piston defining the valve seat is hydraulically displaceable by the pressure applied thereto in the direction opposite to the direction for opening the closure element. With this arrangement, when the opening pressure is achieved, the closure element is lifted away from the valve seat against the restoring force of the spring, and the control piston (and the valve seat) is moved in the opposite direction by the hydraulic pressure into a position in which the closure element is spaced from the valve seat. The control piston remains in this position until the hydraulic pressure drops to a level that lies below that of the opening pressure. This means that, in the setting position, the hydraulic ram connected to the outlet of the sequence valve is permanently connected to the hydraulic pressure line. As a safeguard, the supply line containing the sequence valve may contain a pressure-relief valve. In addition, positive withdrawal of the ram can be achieved by the application of pressure to its annular working chamber, excess pressurized hydraulic fluid from the working chamber connected to said supply line being fed to a return line via the opened sequence valve and the control valve.

If the group of rams is made up of two or more sub-groups, a separate sequence valve, which is set to the particular opening pressure, may be associated with each sub-group. Generally, however, it suffices if a sequence valve is associated only with a ram (or a pair of rams) of the group that has (or have) a resistance to the working stroke that is less than that of the other ram(s) of the same group. The pressure at which the sequence valve opens is set at a level which is at least equal to the hydraulic pressure at which the ram(s) with the greater resistance execute the working stroke. In the case of a roof support unit having hydraulic props arranged one behind the other in the advance direction, the sequence valve is associated with that prop (or pair of props) having a resistance to extension that is less than that of the other prop (or pair of props). In the case of a roof support unit provided with a forwardly-projecting roof cap, this is normally the prop (or props) positioned to the rear with respect to the advance direction.

Advantageously, the control piston is displaceable by hydraulic pressure applied thereto in the direction opposite to the direction for opening the sequence valve. Preferably, the control piston is designed as a stepped piston. Conveniently, the control piston is biassed by a spring member in the direction opposite to that of the biassing force of the spring, the spring force of the spring member being less than that of the spring. The sequence valve is hydraulically controlled so that, on opening, the control piston is pushed into a position in which the closure element is lifted away from the valve seat. Moreover, it cannot be returned in the direction for closing by the hydraulic pressure acting on it, as long as the hydraulic pressure does not fall below the opening pressure (that is to say said predetermined hydraulic pressure). This also means that the sequence valve remains open in normal operations when the pressure in the connected ram is considerably higher than the opening pressure, so that fluid emerging from that ram (for example when excess pressure or positive ram withdrawal occurs) is able to flow through the sequence valve in the opposite direction.

In a preferred embodiment, an abutment member is provided within the valve body, the abutment member being effective to move the closure element away from the valve seat upon movement of the control piston. Preferably, a plunger constitutes the abutment member, and the plunger is displaceably mounted within a continuous axial bore in the control piston. In this case, the valve stem of the closure element may extend away from the spring and engage within the axial bore of the control piston. The arrangement is such that, when the control piston is hydraulically displaced, the valve stem moves into abutment with the plunger and thus immobilizes the closure element relative to the control piston.

Advantageously, in the closed position of the valve, a gap is present between the adjacent end portions of the valve stem and the plunger, said gap being smaller than the working stroke of the control piston in the biassing direction of the spring. Conveniently, the plunger is braced against a shoulder of a hydraulic connector secured to the valve body. In this case, a valve stem of the control piston may be guided in a fluid-tight manner in an axial bore formed in the hydraulic connector.

Preferably, the spring acts on the valve closure element via a washer. An abutment shoulder for the washer may be provided within the valve body.

Advantageously, the control piston is spaced, when the valve is closed, from an annular shoulder provided within the valve body, so that lost motion occurs when the control piston moves in the direction opposite to the biassing direction of the spring.

Said piston face may surround the valve seat. Preferably, the area of said piston face, which is acted upon by the hydraulic pressure at the output side of the sequence valve, is greater than the area of the piston face disposed at the opposite end of the control piston and acted upon by the pressure at the input side of the sequence valve.

Conveniently, the setting member is provided at one end of the valve body, and the hydraulic connector is provided at the other end of the valve body.

Advantageously, the plunger and the valve stem of the closure element move in the continuous axial bore of the control piston in such a manner as to leave a hydraulic duct therethrough.

The invention also provides a roof support unit comprising a roof cap supported by first and second hydraulic props, a working chamber of each of the hydraulic props being connected to the output side of a common control valve via a respective supply line, the input side of the control valve being connected to a hydraulic pressure line, wherein a sequence valve is provided in one of said supply lines, the sequence valve being such as to open the associated supply line only when subjected to a predetermined hydraulic pressure, said predetermined hydraulic pressure being at least approximately equal to the hydraulic pressure necessary to overcome the resistance to the working stroke of the other hydraulic prop.

Advantageously, the first and second props are spaced apart in the advance direction of the unit, and wherein the sequence valve is positioned in the supply line leading to the rear hydraulic prop.

The invention further provides a roof support unit comprising a roof cap supported by first and second pairs of hydraulic props, a working chamber of each of the hydraulic props of each pair being connected to the output side of a common control valve via a respective supply line, the input side of the control valve being connected to a hydraulic pressure line, wherein a sequence valve is provided in one of said supply lines, the sequence valve being such as to open the associated supply line only when subjected to a predetermined hydraulic pressure, said predetermined hydraulic pressure being at least approximately equal to the hydraulic pressure necessary to overcome the resistance to the working strokes of the hydraulic props of the pair of props not associated with the sequence valve.

In this case, it is advantageous for the first and second pairs of props to be spaced apart in the advance direction of the unit, and for the sequence valve to be positioned in the supply line leading to the rear pair of hydraulic props.

BRIEF DESCRIPTION OF THE DRAWINGS

A hydraulic control arrangement incorporating a sequence valve constructed in accordance with the invention will now be described, by way of example, with reference to the accompanying drawings, in which.

DESCRIPTION OF PREFERRED EMBODIMENT

Figure 1:
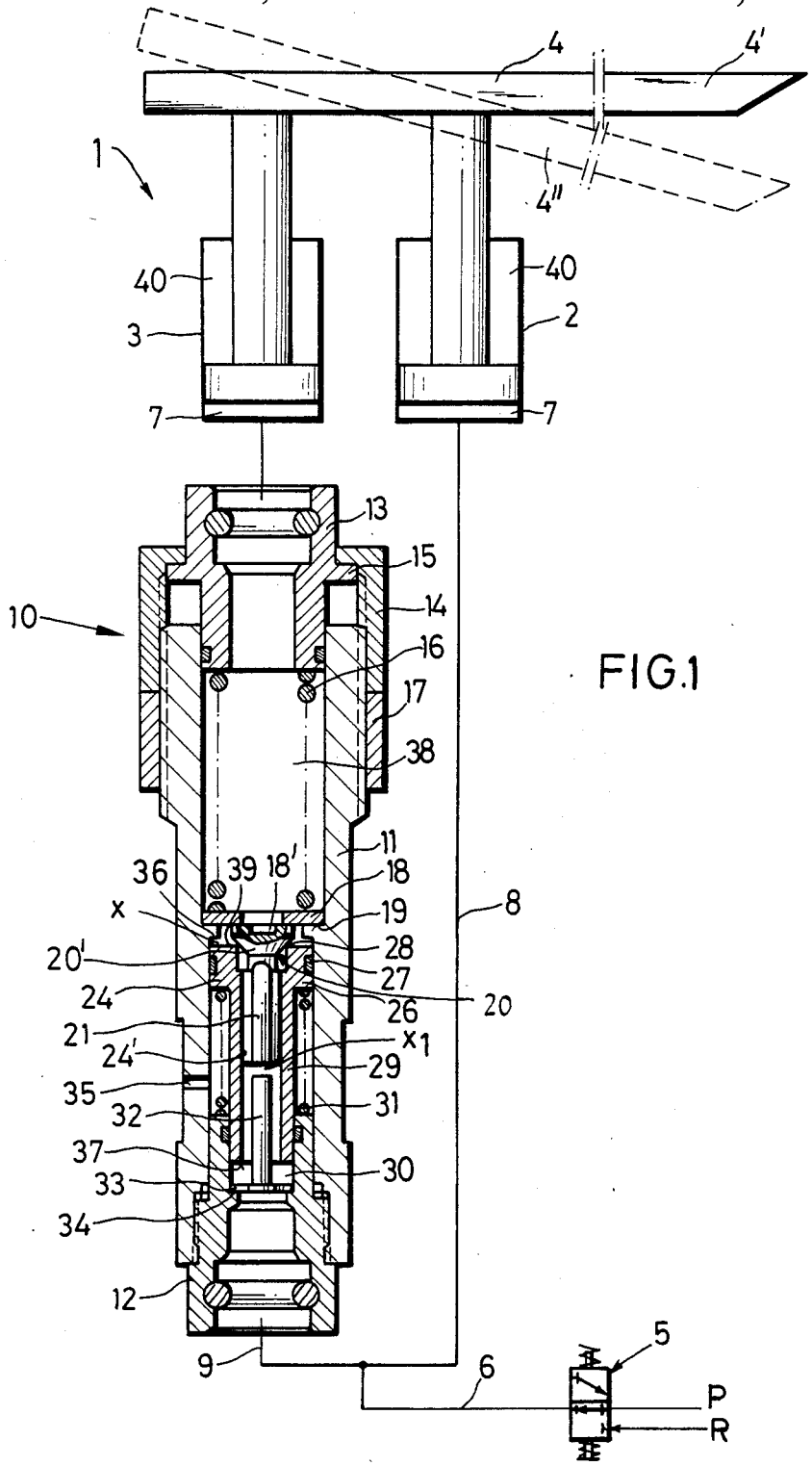
FIG. 1 is a diagrammatic representation of the hydraulic control arrangement, and shows the sequence valve on a larger scale and in longitudinal section.

Referring to the drawings, FIG. 1 shows a mine roof support unit which forms part of a roof support assembly extending along a longwall working. The mine roof support unit comprises two hydraulic props 2 and 3, which support a roof cap 4 upon a floor sill (not shown). The roof cap 4 is used to support the roof of a mine working and, as shown at 4', projects over a relatively great distance beyond the front prop 2 towards the work face (not shown). The roof cap 4 may be provided, in the known manner, with an extension (not shown) which is slidably or pivotally displaceable in the direction of the work face. The props 2 and 3, which are arranged one behind the other, are supported on the floor sill, which may be constituted by a common one-piece floor girder. The roof support unit is also provided with an advance mechanism (not shown) for advancing the unit to follow up the advance of the work face as it is won. The roof support unit may, alternatively, have four hydraulic props arranged one at each corner of a rectangle. In this case, the roof support unit has two front props 2 and two rear props 3, and the floor sill may be constituted by a pair of laterally-spaced floor girders, each pair of props 2, 3 being associated with a respective floor girder.

The props 2 and 3 are supplied with pressurized hydraulic fluid by way of a setting or control valve 5. The control valve 5 can be operated manually and/or by remote control. The input side of the control valve 5 is connected to a pressure line P and to a return line R. The lines P and R extend along the longwall working, and supply hydraulic fluid to all the roof support units constituting the roof support assembly. The output side of the control valve 5 is connected by a line 6 to the working chambers 7 of the props 2 and 3. Downstream of the control valve 5, the line 6 branches into a supply line 8, leading to the working chamber 7 of the front prop 2, and into a supply line 9 which leads to the working chamber 7 of the rear prop 3. Where the roof support unit has two front props 2 and two rear props 3, the line 8 supplies the working chambers 7 of both the front props, and the line 9 supplies the working chambers of both rear props. A sequence valve 10 is provided in the supply line 9. The description of the arrangement will, from now on, refer to the situation where the roof support unit has only one front prop 2 and one rear prop 3. It will be appreciated, however, that the arrangement will work in a similar manner where the roof support unit has two front props 2 and two rear props 3.

It will be seen that, because of the forward extension of the roof cap 4, the front prop 2 is more heavily loaded by the weight of the roof cap than is the rear prop 3. Consequently, the resistance to extension of the front prop 2 is considerably greater than that of the rear prop 3. Thus, if the sequence valve 10 were not present, then, in the illustrated position of the control valve 5 (in which the lines 6, 8 and 9 are connected to the pressure line P) the rear prop 3 would be extended to lift the rear portion of the roof cap 4 towards the roof of the working before the front prop 2 starts to extend. A pressure of, for example, 20 bars in its working chamber 7 suffices to extend the rear prop 3 so as to engage the roof cap 4 with the roof, whereas a pressure of, for example, 50 bars is needed for imparting outward thrust to the front prop 2. Only when the props 2 and 3 have been extended sufficiently to engage the roof cap 4 with the roof does the full working pressure of the pressure line P build up in the working chambers 7. Because the rear prop 3 tends to be extended first, the roof cap 4 tends to assume an inclined position (as shown in dashed lines 4'') as the roof support unit is set in position. If the roof contains a cavity above the rear prop 3, that is to say in the zone of the goaf, the rear end of the roof cap 4 can be raised into this cavity, and the roof cap can then be clamped in this inclined position against the roof. In some circumstances, it is then not possible to bring the forward extension of the roof cap 4 into engagement with the roof, and to clamp it thereagainst by means of the setting force of the front prop 2.

However, by providing the sequence valve 10 in the supply line 9 the props 2 and 3 are caused to move out practically simultaneously when the roof-support unit is being set; and the roof cap 4 is, therefore, pressed against the roof under the full setting force of both props. Thus, the sequence valve 10 effects synchronism in the movement of the props 2 and 3, despite differing loading by the roof cap 4.

The sequence valve 10 is so designed that it opens the supply line 9 to the working chamber 7 of the rear prop 3 only when a hydraulic pressure, great enough to extend the front prop 2 against the loading of the roof cap 4, has built up in the line 9 (and hence also in the lines 6 and 8) when the control valve 5 is switched to the setting position. In the case of the example described above, this pressure is 50 bars. As soon as this pressure has built up in the working chamber 7 of the front prop 2, via the lines 6 and 8, and the prop 2 has started to extend, the sequence valve 10 opens to establish hydraulic connection with the rear prop 3. Thus, the working chamber 7 of the rear prop 3 is acted upon by the same pressure of approximately 50 bars as the front prop 2, and the two props are extended in synchronism until the roof cap 4 moves into engagement with the roof, and the required setting pressure is able to build up in the working chambers 7 of the two props.

The sequence valve 10 is suitable for immediate fitting in the supply line 9. It has a tubular body 11 having a stepped internal bore, into one end of which is screwed a connector 12. The connector 12 is formed with a continuous stepped bore, and is designed as a fitting for connecting a hydraulic hose. An adjustment member 13 is provided at the other end of the body 11, the adjustment member also having a stepped bore and being designed as a fitting for connecting a hydraulic hose. The adjustment member 13 is guided in a fluid-tight manner in the stepped bore of the body 11, and is attached to the body by means of a cap nut 14. The cap nut 14 engages a flange 15 formed on the adjustment member 13. The adjustment member 13 forms an abutment for a spring 16, which is arranged within the stepped bore of the valve body 11. The biassing force of the spring 16 can be adjusted to set the opening pressure of the sequence valve 10 by means of the cap nut 14. The cap nut 14 is held on the valve body 11 by means of a lock nut 17. The spring 16 acts on a washer 18, which is supported against an annular shoulder 19 provided within the stepped bore of the valve body 11. The washer 18 is provided with openings through which pressurized hydraulic fluid can flow. The washer 18 is generally star-shaped, so that pressurized hydraulic fluid flowing through the bore of the valve body 11, and between the input and output sides of the sequence valve, can flow through the washer.

Figure 4:
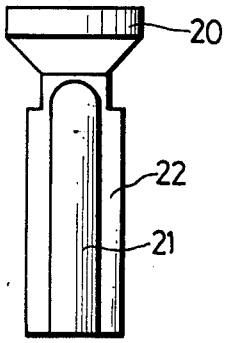
FIG. 4 is an enlarged side elevation of another part of the sequence valve; and, FIG. 5 is a longitudinal section through the valve part shown in FIG. 4.
Figure 5:
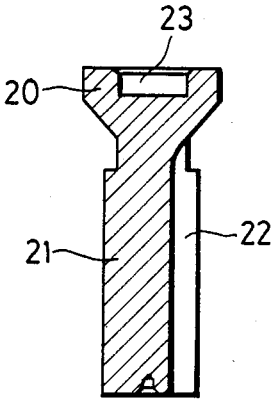

The sequence valve 10 has a closure element 20 which bears against the washer 18. As shown in FIGS. 4 and 5, the closure element 20 has frustoconical head 20' carried by an axially-extending valve stem 21. The valve stem 21 is generally star-shaped in cross-section, having three axial grooves 22 which form ducts for the pressurized hydraulic fluid. The grooves 22 are spaced by 120° around the valve stem 21. The head 20' of the valve closure element 20 has a circular recess 23 in its upper end. A centering stud 18', which is positioned on the lower face of the washer 18, engages within the recess 23 to center and brace the closure element 20.

The closure element 20 is guided by its stem 21 in the bore 24' of a stepped control piston 24 which acts as a valve seat member. The part 26 of the piston 24 that is of greater diameter is guided in the bore of the valve body 11. A seal (not shown) is provided on the piston part 26. The piston part 26 is shaped to define a conical valve seat 28 which matches the frustoconical shape of the head 20' of the valve closure element 20. The control piston 24 has an annular portion 29 of reduced diameter, this portion being guided in a fluid-tight manner in the stepped bore 30 of the connector 12. The piston portion 29 is surrounded by a spring 31, one end of which bears against the inner end-face of the connector 12, the other end of this spring bearing against an annular shoulder formed by the rear side of the part 26 of the control piston 24. The spring 31 acts in the direction opposite that in which the spring 16 acts, and has a considerably smaller rating than the spring 16.

Figure 2:
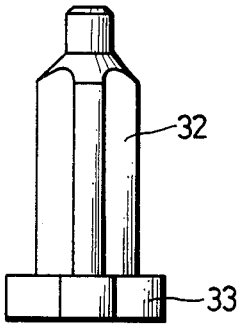
FIG. 2 is an enlarged side elevation of part of the sequence valve.
Figure 3:
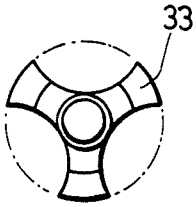
FIG. 3 is a plan view of the valve part shown in FIG. 2.

A plunger 32 engages within the bore 24' of the control piston 24, the plunger 32 having a lower end portion 33 which bears against an annular shoulder 34 provided within the connector 12. As shown in FIGS. 2 and 3, the lower end portion 33 is generally star-shaped, so that fluid can flow through the bore 30 of the connector 12. The plunger 32 is also generally star-shaped in cross-section, so that it is able to move in the bore 24' of the piston portion 29 while permitting fluid to flow through the bore 24'. The stem 21 of the closure element 20, and the washer 18 also have the same generally star-shaped construction. The annular space at the periphery of the piston portion 29 that accommodates the spring 31 communicates with the atmosphere by way of a vent 35.

FIG. 1 shows the sequence valve 10 in the closed position, in which the spring 16 holds the washer 18 in contact with the annular shoulder 19. In this position, the spring 31 presses the control piston 24 into a position in which the head 20' of the closure element 20 bears against the washer 18 and rests against the valve seat 28. In this closed position, there is a slight gap X between the end face of the control piston part 26 and an annular shoulder 36 provided within the valve body 11. Similarly, there is a slight gap $X_1$ between the free end of the valve stem 21 and the adjacent end of the plunger 32. In use, the gaps X and $X_1$ give rise to lost motion, as is described below.

If the supply lines 8 and 9 are connected to the pressure line P by way of the control valve 5, hydraulic pressure builds up in these lines and in the working chamber 7 of the front prop 2. The opening pressure of the sequence valve 10, which is set by the spring 16 using the adjustment member 13, is arranged to correspond to the pressure built up in the lines 8 and 9 and in the working chamber 7 of the front prop 2. This pressure corresponds substantially to that pressure at which the front prop 2 begins to move out against the resistance to extension caused by the weight of the roof cap 4. This hydraulic pressure acts on the annular end face 37 of the portion 39 of the control piston 24. Thus, when the opening pressure is reached, the control piston 24, together with the closure element 20 and the washer 18, moves in the direction opposite that of the restoring force of the spring 16 until the lost motion corresponding to the gap X is taken up. The control piston 24 then strikes the annular shoulder 36. The hydraulic pressure also acts from below on the closure element 20 to lift this element from the valve seat 28 against the restoring force of the spring 16, so that the hydraulic pressure also builds up in the chamber 38 of the sequence valve 10. Consequently, the annular end face 39 formed on the control piston 24 at the periphery of the valve seat 28 is acted upon by the hydraulic pressure. This end face 39 is larger than the end face 37 at the opposite end of the control piston 24, so the control piston is forced back within the bore of the valve body 11 in the direction opposite to that of the restoring force of the spring 31. When the lost motion corresponding to the gap $X_1$ has been taken up, the valve stem 21 of the closure element 20 moves into abutment with the plunger 32, so that further movement of the control piston 24 towards the connector 12 lifts the closure element away from the valve seat 28, and so opens the sequence valve 10. Pressurized hydraulic fluid at the predetermined opening pressure can, therefore, pass to the working chamber 7 of the rear prop 3. Consequently, the rear prop 3 moves out together with the front prop 2.

As soon as the roof cap 4 moves into contact with the roof, the hydraulic pressure in the pressure line P builds up in the working chambers 7 of the props 2 and 3. With the props 2 and 3 extended to set the roof cap 4 against the roof, this pressure acts continuously on the larger end face 39 of the control piston 24, so that the sequence valve 10 remains open, and pressurized hydraulic fluid is able to flow from the working chamber 7 of the rear prop 3 in the opposite direction, by way of the sequence valve and a pressure-relief valve (not shown) associated therewith. In the setting position, the washer 18 is forced, by the spring 16, against the annular shoulder 19 of the valve body 11.

The control piston 24 is pressed back by the spring 31 into the illustrated control position, in which the closure element 20 bears against the valve seat 28, only when the pressure in the chamber 38 (and, therefore, in the working chamber 7 of the prop 3) drops to a level below the opening pressure.

In order to withdraw the roof cap 4 of the roof support unit, the annular working chambers 40 of the props 2 and 3 are pressurized. When this happens, hydraulic pressure builds up in the working chamber 7 of the rear prop 3. This pressure acts on the end face 39 of the control piston 24 so as to open the sequence valve 10. Pressurized hydraulic fluid is then fed, by way of the control valve 5, to the return line R. Positive withdrawal of the associated prop 3 is, therefore, not prevented by the sequence valve 10.

Since the sequence valve 10 is held in the open position by the pressure acting on the end face 39 in the biassing direction of the spring 16, the prop 3 can be set using the full pressure in the line P. The spring 16 is not important in the closing of the pressure-controlled sequence valve 10. It simply determines the pressure at which the sequence valve 10 opens to connect the pressure line P with the prop 3. By using the adjustment member 13, the bias of the spring 16 can be set to suit the particular operating conditions.

It will be apparent that the particular form of sequence valve described above, and its particular use in a roof support unit, could be modified in a number of ways. For example, the sequence valve could be used for synchronizing the working strokes of several hydraulic rams which have different resistances to extension, or which are under different loads, the rams being controlled by a common control valve. The sequence valve may also be used to regulate the sequence of the retraction and extension movements of several hydraulic rams, which may have the same or different loads or resistances to movement. Such hydraulic rams may be the hydraulic advance rams of mine roof support units, the hydraulic rams used to position the roof caps of such units, the hydraulic rams used to position gap-sealing side shields of such units, or the rams used to align such units.

We claim:

1. An apparatus for controlling the working stroke of each hydraulic ram of a group of hydraulic rams wherein each ram has a working stroke which causes resistance in a hydraulic pressure supply line, the apparatus comprising:

(a) a control valve having an input side connectible to a hydraulic pressure line and an output side connectible to a working chamber of each of the hydraulic rams via a respective supply line, (b) a sequence valve is disposed in one of the supply lines and includes means to open the associated supply line only when subjected to a predetermined hydraulic pressure in said supply line that is at least approximately equal to the hydraulic pressure developed in said associated supply line necessary to overcome the resistance to the working stroke of another hydraulic ram of the group.

2. Apparatus according to claim 1, wherein the sequence valve includes means to vary said predetermined hydraulic pressure in the associated supply line.

3. Apparatus according to claim 1, wherein the resistance to the working stroke of the hydraulic ram associated with the sequence valve is less than that of another hydraulic ram of the group, and said predetermined hydraulic pressure is at least equal to the hydraulic pressure which is required to execute the working stroke of said another hydraulic ram of the group that has the greatest resistance to its working stroke.

4. In an apparatus for controlling the working stroke of each hydraulic ram of a group of hydraulic rams having working chambers wherein each ram has a working stroke which causes resistance in a hydraulic pressure supply line, the combination comprising:

(a) a control valve having an input side connectible to a hydraulic pressure line and an output side connectible to a working chamber of each of the hydraulic rams via a respective supply line, (b) a sequence valve in one of the supply line associated with one of the rams and includes means to open the associated supply line only when subjected to a predetermined hydraulic pressure in said supply line that is at least approximately equal to the hydraulic pressure developed in said associated supply line necessary to overcome the resistance to the working stroke of another hydraulic ram of the group.

5. The combination according to claim 4, wherein the sequence valve comprises a valve body, a valve closure element mounted within the valve body, a valve seat positioned within the valve body, and a spring for biassing the valve closure element towards the valve seat, and said opening means includes a control piston which defines the valve seat and has a piston face which, when subjected to hydraulic pressure in the biassing direction of the spring, is effective to displace the control piston so as to move the valve seat away from the valve closure element, thereby opening the sequence valve.

6. A sequence valve for controlling the flow of hydraulic fluid in a supply line leading to a working chamber of a hydraulic ram, the sequence valve comprising:

(a) a tubular valve body, (b) a valve closure element mounted within the valve body, (c) a valve seat positioned within the valve body, (d) a spring for biassing the valve closure element towards the valve seat, and (e) means for opening the supply line only when subjected to a predetermined pressure, (f) said opening means including a control piston defining the valve seat and having a piston face disposed to be subjected to hydraulic pressure in the biassing direction of the spring, (g) said control piston being effective to move the valve seat away from the valve closure element when the piston face is subjected to a predetermined hydraulic pressure thereby opening the sequence valve, and (h) the area of said piston face, which is acted upon by the hydraulic pressure at the output side of the sequence valve, is greater than the area of the piston face disposed at the opposite end of the control piston and acted upon by the pressure at the input side of the sequence valve.

7. A sequence valve according to claim 6, wherein the valve closure element has a generally frustoconical head and an axially-extending valve stem, the head being engageable with the valve seat.

8. A sequence valve according to claim 6, wherein an adjustable setting member acts as an abutment for the spring to vary the biassing force of the spring.

9. A sequence valve according to claim 8, wherein the setting member also constitutes a hydraulic connector.

10. A sequence valve according to claim 6, wherein the control piston is a stepped piston.

11. A sequence valve according to claim 10, wherein the control piston constitutes the retaining device, the piston face of the control piston being acted upon by the hydraulic pressure in the working chamber of the associated hydraulic ram.

12. A sequence valve according to claim 6, wherein the control piston is displaceable by hydraulic pressure applied thereto in the direction opposite to the direction for opening the sequence valve.

13. A sequence valve according to claim 6, wherein the control piston is designed as a stepped piston.

14. A sequence valve according to claim 6, wherein the control piston is biassed by a spring member in the direction opposite to that of the biassing force of said biassing spring, the spring force of the spring member being less than that of the biassing spring.

15. A sequence valve according to claim 7, wherein an abutment member is provided within the valve body, the abutment member being effective to move the closure element away from the valve seat upon movement of the control piston.

16. A sequence valve according to claim 15, wherein the abutment member is a plunger.

17. A sequence valve according to claim 16, wherein the plunger is displaceably mounted within a continuous axial bore in the control piston.

18. A sequence valve according to claim 17, wherein the valve stem of the closure element extends away from the spring and engages within the axial bore of the control piston.

19. A sequence valve according to claim 18, wherein, in the closed position of the valve, a gap is present between the adjacent end portions of the valve stem and the plunger, said gap being smaller than the working stroke of the control piston in the biassing direction of the spring.

20. A sequence valve according to claim 16, wherein the plunger is braced against a shoulder of the hydraulic connector secured to the valve body.

21. A sequence valve according to claim 20, wherein a valve stem of the control piston is guided in a fluid-tight manner in an axial bore formed in the hydraulic connector.

22. A sequence valve according to claim 6, wherein the spring acts on the valve closure element via a washer.

23. A sequence valve according to claim 22, wherein an abutment shoulder for the washer is provided within the valve body.

24. A sequence valve according to claim 6, wherein the control piston is spaced, when the valve is closed, from an annular shoulder provided within the valve body, so that lost motion occurs when the control piston moves in the direction opposite to the biassing direction of the spring.

25. A sequence valve according to claim 6, wherein said piston face surrounds the valve seat.

26. A sequence valve according to claim 20, wherein the setting member is provided at one end of the valve body, and the hydraulic connector is provided at the other end of the valve body.

27. A sequence valve according to claim 16, wherein the plunger and the valve stem of the closure element move in the continuous axial bore of the control piston in such a manner as to leave a hydraulic duct therethrough.

28. A roof support unit comprising:

(a) a roof cap supported by first and second hydraulic props each having a working chamber with a working stroke and being connected to the output side of a common control valve via a respective supply line, (b) the input side of the control valve being connected to a hydraulic presssure line, (c) a sequence valve disposed in one of said supply lines and including means to open the associated supply line only when subjected to a predetermined hydraulic pressure in said supply line that is at least approximately equal to the hydraulic pressure developed in said associated supply line necessary to overcome the resistance to the working stroke of the other hydraulic prop.

29. A roof support unit according to claim 28, wherein the first and second props are spaced apart in the advance direction of the unit, and the sequence valve is positioned in the supply line leading to the rear hydraulic prop.

30. A mining installation comprising:

(a) first and second hydraulic rams, a hydraulic pressure line, and control apparatus for controlling the working stroke of the first and second hydralic rams, (b) the first hydraulic ram being operable in response to the hydraulic pressure in said hydraulic pressure line reaching a first predetermined pressure, (c) the second hydraulic ram being operable in response to the hydraulic pressure in said hydraulic pressure line reaching a second predetermined pressure, (d) the second predetermined pressure being higher than the first predetermined pressure, (e) the control apparatus including a sequence valve and a control valve having an input side and an output side;

(f) the input side of the control valve being connected to the hydraulic pressure line, and (g) the output side of the control valve being connected to a working chamber of each of the hydraulic rams via a respective supply line, (h) the sequence valve being positioned in the supply line leading to the first hydraulic ram, (i) the sequence valve including means for opening the associated supply line in response to the hydraulic pressure in said hydraulic pressure line reaching a valve substantially equal to the second predetermined pressure, whereby the first and second hydraulic rams operate substantially simultaneously.

31. A sequence valve for controlling the flow of hydraulic fluid in a supply line leading to a working chamber of a hydraulic ram, the sequence valve comprising:

(a) a tubular valve body having an input side and an output side, (b) a control piston slidably mounted within the valve body, (c) a valve closure element mounted within the valve body, (d) a valve seat positioned within the valve body, and (e) spring means for biassing the valve closure element toward the valve seat, (f) the control piston having a first piston face exposed to hydraulic pressure at the input side of the sequence valve and a second piston face exposed to hydraulic pressure at the output side of the sequence valve, (g) the area of the second piston face being greater than the area of the first piston face whereby, when the second piston face is subjected to hydraulic pressure at the output side of the sequence valve, the control piston is displaced in the biassing direction of the spring to move the valve seat away from the valve closure element, thereby opening the sequence valve, (h) the sequence valve being effective to open the supply line only when subjected to a predetermined hydraulic pressure.

* * * * *